United States Patent [19]

Swisher

[11] 4,262,946

[45] Apr. 21, 1981

[54] METER LOCK SEAL

[76] Inventor: James A. Swisher, 464 Mill Hill Dr., Southport, Conn. 06490

[21] Appl. No.: 930,180

[22] Filed: Aug. 2, 1978

Related U.S. Application Data

[63] Continuation-in-part of Ser. No. 812,718, Jul. 5, 1977.

[51] Int. Cl.[2] ..... B65D 33/34

[52] U.S. Cl. ..... 292/307 R

[58] Field of Search ..... 292/307, 316, 326, 327

[56] References Cited

U.S. PATENT DOCUMENTS

| | | | |
|---|---|---|---|
| 1,037,010 | 8/1912 | Irons | 292/307 R |
| 1,487,159 | 3/1924 | Heeren | 292/307 R |
| 2,530,899 | 11/1950 | Mueller | 292/307 R |
| 4,008,914 | 2/1977 | Anderson | 292/307 R |

*Primary Examiner*—Richard E. Moore

[57] ABSTRACT

A frangible plug for sealing the access opening of a barrel lock, particularly such a lock installed in an electric meter box lock, the plug being so designed and installed that it cannot be removed without being destroyed, thus giving positive visible indication that the integrity of the seal has or has not been violated.

13 Claims, 14 Drawing Figures

METER LOCK SEAL

This application is a continuation-in-part of Ser. No. 812,718, filed July 5, 1977.

This invention relates to a plug for sealing an opening and in particular the open end of a tube containing a barrel lock, the plug being partly of glass or the like and being installed in the lock tube or other opening in such a manner that it cannot be removed without being destroyed. As shown herein, the plug is used for the protection of the barrel lock which is installed within the same tube. It is adapted for use in connection with a Meter Box Guard Lock of the type disclosed in the co-pending Skarzynski and Swisher application Ser. No. 787,918. The lock shown therein includes a barrel lock cooperating with a tubular member into which the key or picking tool must be introduced in order to actuate the lock.

A locking bolt can be used instead of a barrel lock in certain situations and the cost of the barrel lock saved. If the locking bolt is tampered with, the utility company could install a barrel lock with glass sealing plug as a second approach.

The theft of electric current by means of "rigged" meters, arranged to show only a part of the current actually drawn from the service line, or none at all, is a very serious problem causing great concern among utility companies, who report losses in the millions of dollars per year from the activities of individuals or groups of meter riggers. Conventional locks, such as padlocks, may be deterrents, but their removal and replacement is seldom visibly detectable and therefore does not alert an inspector to the fact of tampering.

While new high security barrel locks are more difficult to "pick" than other locks, special tools can be designed for that purpose.

It is accordingly an object of the present invention to provide highly visible and eye attracting means for closing the approach to a barrel lock, which means cannot be removed except by destruction.

It is another object of the invention to provide such means which can readily be destroyed, removed and replaced by authorized persons entitled to have access to the locked meter.

It is a further object of the invention to provide such means which cannot be duplicated by craftsmen and, once broken, cannot be glued or cemented together.

It is yet another object of the invention to provide a plug in unique shapes and tints, and adapted for sequential numbering.

It is a still further object of the invention to provide a plug of great durability and fire resistance, for long life if not tampered with.

It is another object of the invention to provide a plug having a unique surface on its inner or "vault" face which can be seen from the outside, looking through the outside plug face.

It is also an object of the invention to provide certain improvements in the form, construction, arrangement and materials whereby the above-named and other objects may effectively be attained.

The invention accordingly comprises an article of manufacture possessing the features, properties, and the relation of elements which will be exemplified in the article hereinafter described, and the scope of the invention will be indicated in the claims.

A practical embodiment of the invention is shown in the accompanying drawing wherein.

Figure 1:
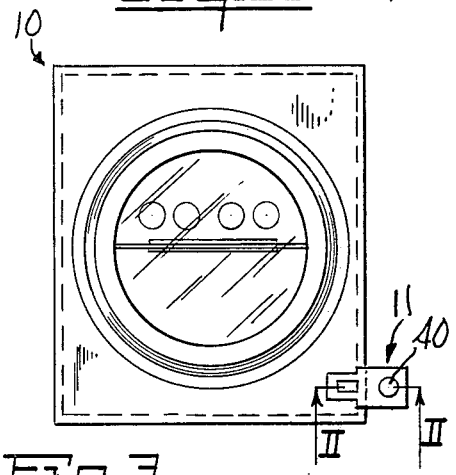
FIG. 1 represents a front elevation of an electric meter, locked by means of the device disclosed in the above-cited application and showing the position of the sealing plug, in use.
Figure 2:
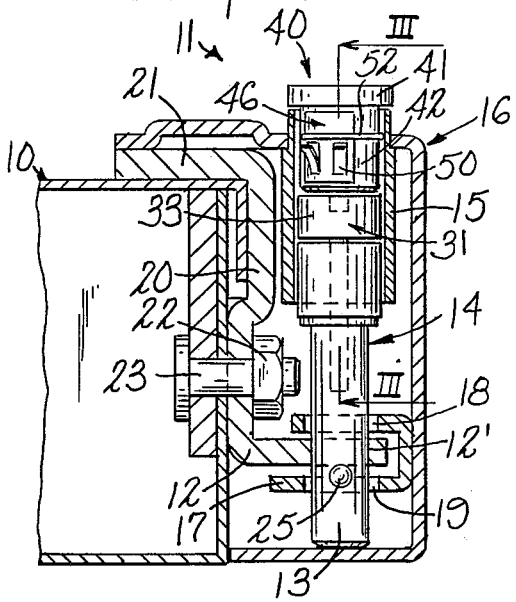
FIG. 2 represents a horizontal section on the line II—II of FIG. 1, looking upward.

Referring to the drawings, a conventional electric meter box 10 is shown as being provided with the security locking device 11 which includes a portion 12 projecting outwardly from the side of the box and bored at 12' to receive the shank 13 of a barrel lock 14. The lock is accommodated in a lock tube 15, forming part of a housing 16 which carries a yoke 17, the arms of which are bored at 18, 19. The Z-shaped piece 20 has one end 21 which overlies the meter box cover and the piece can be bolted in place, as shown in FIG. 2, by the nut and bolt 22, 23. When the box has been thus secured, access to the nut is prevented by placing the housing 16 in a position such that the bores 18, 19 register with the hole 12' in portion 12. The barrel lock 14 is then placed in the tube 15 and its shank 13 is passed through the aligned holes 18, 19 and 12', being locked in the latter by means of the projecting balls 25.

Barrel locks are well known devices, shown, for instance, in Moberg U.S. Pat. No. 3,002,368, No. 3,033,016, and No. 4,015,456. Locking and unlocking is effected by projecting and withdrawing small balls carried in recesses in a shank which can be passed into or through an aperture when the balls are retracted but cannot be removed when the balls are projected. The "key" for actuating such a lock is a tool which can be moved axially into the lock and which is adapted to grip a portion of an axially movable plunger so that the plunger can be withdrawn to release the locking balls. Engagement between the key and the plunger may be of various types—expansion, contraction, etc,—but the keys are not difficult to counterfeit, and it is for this reason that applicant has devised means to prevent access to locks by providing the non-removable plugs described herein.

Figure 3:
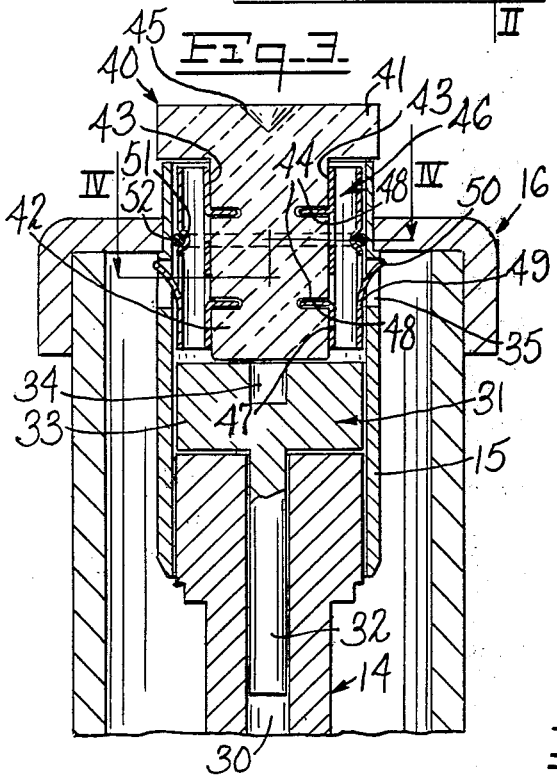
FIG. 3 represents a detail axial section on the line III-13 III in FIG. 2.

Referring particularly to FIG. 3, the axial keyway of the lock is shown at 30. An inner closure 31, of a plastic material, has a stem 32, fitting in the keyway, and a cylindrical head 33 extending over the top of the lock 14 and fitting snugly within the lock tube 15. The head is provided with a small central recess 34, to be engaged by an expansible tool, not shown, for removal when required. The closure 31, or at least the head thereof, should preferably be of white or light colored material to facilitate observation of indicia on the plug. At diametrically opposite points, just within the housing 16, the tube is provided with pairs of windows 35, to receive locking tabs on the plug, as will be described.

Figure 6:
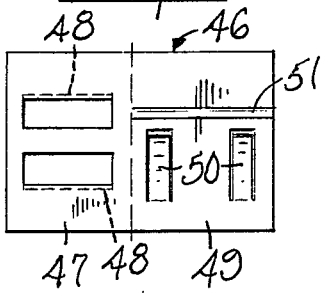
FIG. 6 represents an elevational view of the blank for forming the metal components.
Figure 4:
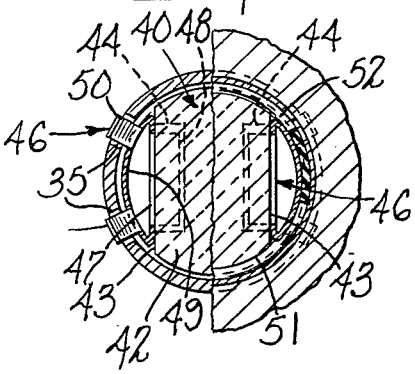
FIG. 4 represents a vertical section on the line IV—IV of FIG. 3.
Figure 8:
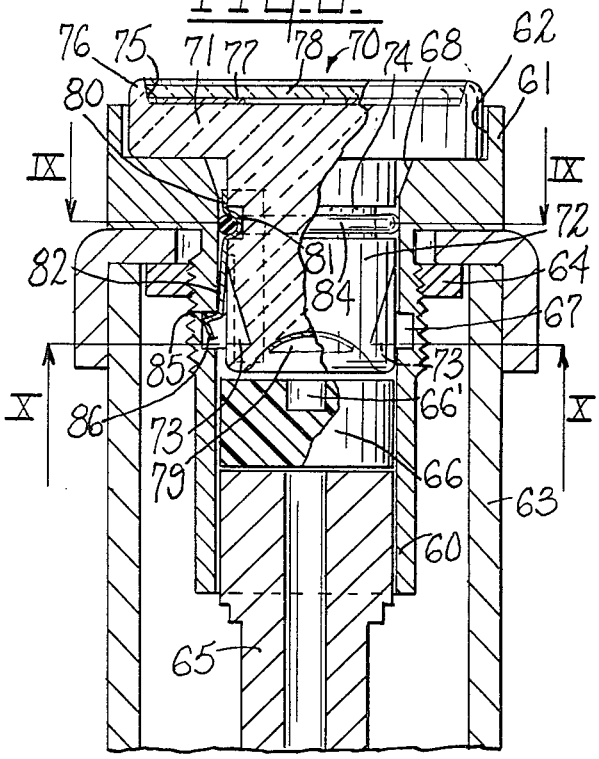
FIG. 8 represents an axial section, as in FIG. 3, showing a modified form of lock tube and modified plug assembly.
Figure 9:
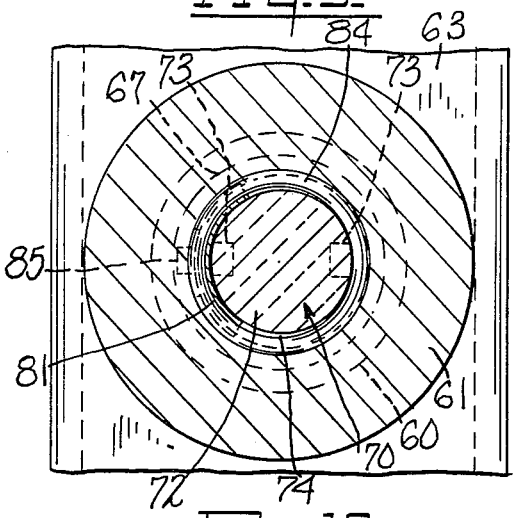
FIG. 9 represents a section on the line IX—IX of FIG. 8, looking in the direction of the arrows.
Figure 10:
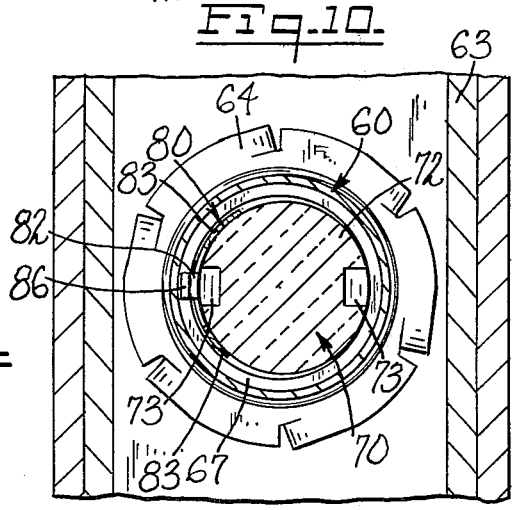
FIG. 10 represents a section on the line X—X of FIG. 8, looking in the direction of the arrows.
Figure 12:
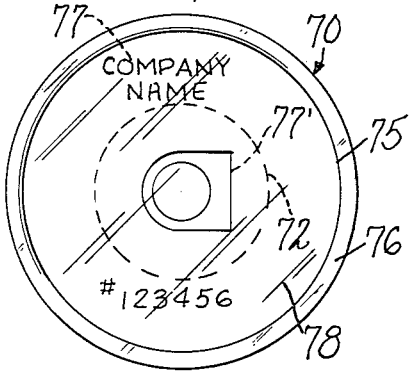
FIG. 12 represents a top plan view of the plug.

The sealing plug 40, preferably of glass, comprises a flat cylindrical head portion 41 and a generally cylindrical base portion 42, the opposite sides 43 of which are flattened and provided with parallel grooves 44. A small depression 45 is formed in the middle of the head surface, for a purpose to be described. The segmentally profiled spaces formed by the flattened sides are occupied by plug keys 46 which may conveniently be made from metal blanks as shown in FIG. 6, each formed key having a flat side 47, from which are struck the parallel lugs 48, spaced to fit in the grooves 44, an arcuate side 49, from which are struck the locking tabs 50, spaced to engage the respective windows 35 in the tube, when the plug is in operative position. An annular groove 51 may be formed around the base portion of the plug in both the glass portion and the metal key portions, to receive an O-ring or the like 52 which provides a physical seal. The lugs 48 have a close friction fit in their respective grooves 44 and/or may be cemented therein for convenience in handling.

The features just described are so proportioned that, with the inner closure 31 in place, the plug 40 can be oriented to bring the tabs 50 into register with their respective windows 35 and can then be moved axially into the tube until the tabs, compressed during insertion, snap into their windows and lock the plug in the tube with its inner or "vault" face near or against the head of the closure 31. This is a one-way operation; the tabs 50 cannot be retracted and any efforts to pry the plug loose will cause it to rupture at one or more points including the reduced cross-sections between opposite pairs of grooves 44. Thus, any attempt at tampering with the lock, as a preliminary to meter tampering, will be apparent without close inspection.

Figure 5:
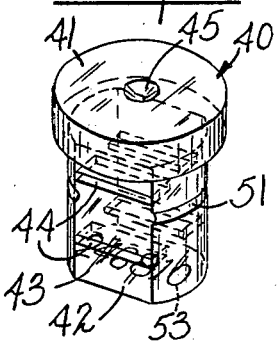
FIG. 5 represents an isometric view of the glass component.

The glass used in the plug should have shattering characteristics such that breaks are difficult or impossible to repair and should also be heat resistant to prevent accidental destruction in case of fire. Tinted glass may be used, for identification, and the plugs may be sequentially numbered for record-keeping purposes. The plug head portion is shown as a flat cylinder, but it could take other forms such as hexagonal and/or have special surface configurations. Indicia on the vault face cannot be tampered with, due to its location at 53, FIG. 5.

Figure 7:
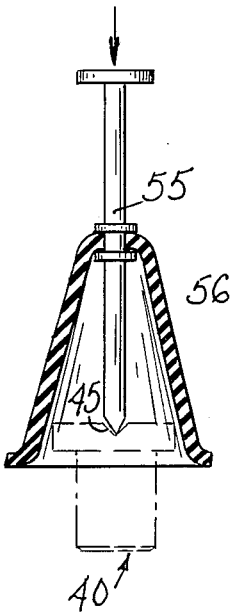
FIG. 7 represents an axial section of the removal tool in position for use.

Electric meter boxes seldom require opening, except to check on a malfunction or to reset the dials. When it is necessary for a box to be opened by authorized personnel, the tool shown in FIG. 7 may be used. This consists of a spike 55 on which is mounted a conical rubber or plastic skirt 56, wide enough at its base to fit freely around the head portion of a plug and to rest against the adjacent surface of the meter box. In use, the point of the spike is engaged in the depression 45, the skirt is held against the box, and the spike is given a sharp blow in with a hammer. This will shatter the glass portion of the plug, the broken glass being restrained by the skirt, and further blows being delivered, if necessary, to complete the destruction of the base portion sufficiently to permit removal of the metal plug keys. A suitable tool is then engaged in the recess 34 of the closure 31, in order to pull the closure out, and the keyway is thus exposed for admittance of the special barrel lock key, for removal of the lock, freeing of the housing 16 and unscrewing of the nut 22 so that the box can be opened. To reseal the box with a new plug the steps are reversed.

In FIGS. 8 to 12 is shown a modified form of lock tube 60 having a head portion 61 topped by a flanged recess 62. The tube may be threaded and mounted in the housing 63 by means of the nut 64. The barrel lock 65 corresponds to the lock 14 in FIGS. 2 and 3 and the inner closure 66, with central recess 66', corresponds to the closure 31, but is shown without the depending stem 32. Instead of oppositely disposed windows 35 the inner surface of the tube bore is provided with an annular groove 67 and the outer end of the bore is beveled as shown at 68.

The glass sealing plug 70 has a cylindrical head portion 71 and a generally cylindrical base portion 72, the opposite sides of which are recessed as indicated at 73, and an annular groove 74 is formed in the base between the head and the recesses. The surface of the head portion is provided with a depression 75 bounded by the annular flange 76 and an annular paper or plastic label 77 may be seated in the depression and protected by a glass of plastic wafer 78. A distinctively colored spot 79 may be applied to the dished inner face of the plug to aid in observation of the plug's condition. The diameter of the head portion is such that it can fit freely in the recess 62 where the peripheral flange prevents "jimmying "efforts.

The plug key or clip 80 (FIGS. 8 and 11) is formed of spring steel, bent in an arc of 120° or less, with an external groove 81 parallel to one end and an outwardly bent tongue 82 between two skirt portions 83. The internal ridge corresponding to the goove 81 fits in the groove 74 on the plug and the clip is held in operative position on the plug by means of an O-ring 84 in the groove 81; in this position the tongue 82 is centered opposite a recess 73 and a second clip (not shown) may be similarly held on the opposite side of the plug. Adjacent its free end the tongue is bent outward to form a latch surface 85 and inward to provide a beveled surface 86 which cooperates with the beveled portion 78 of the tube bore to facilitate introduction of the plug and clip into locking position.

Figure 13:
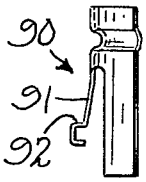
FIG. 13 represents a side elevation of a modified form of clip.
Figure 11:
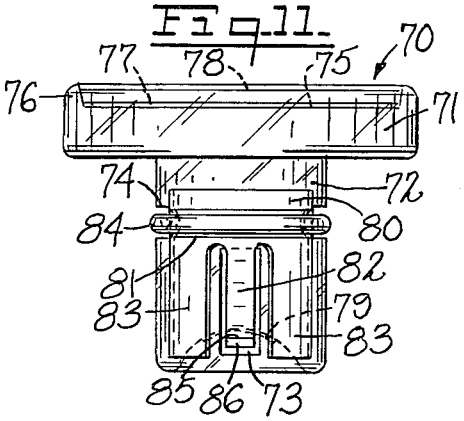
FIG. 11 represents an elevational view of the plug and clip assembly, turned 90° from the position shown in FIG. 8.

In FIG. 13 is shown, in profile, a modified form of clip 90 wherein the tongue 91 has its free end bent at three points to provide a latch surface 92 backed by right-angled portions instead of the beveled surface 86.

The opening 77' in the center of the label 77 may be circular or other suitable shape so long as it permits visual inspection of the interior of the plug to ascertain the integrity thereof. If the plug is in sound condition, an observer looking in an axial direction, as through the opening 77', will see not only the colored spot 79 but also a reflection of the spot from the radially inner surface of the recess 73 which reflection will be distorted, eliminated, or interfered with if the plug is internally cracked.

Figure 14:
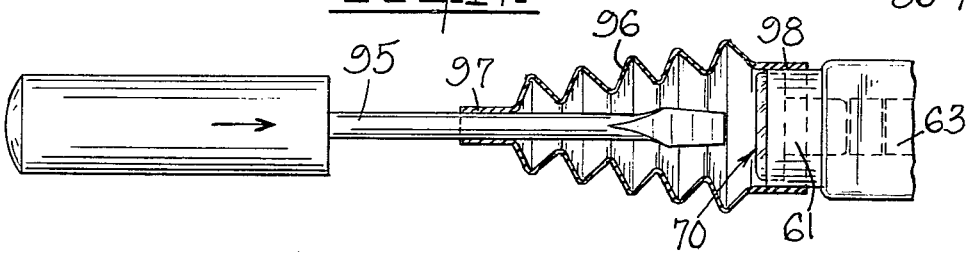
FIG. 14 represents an axial section of a modified form of removal tool in position for use.

The sealing plug assembly of FIGS. 8 to 12 is used in the same manner as that shown in FIGS. 1 to 6 except that the provision of groove 67 (instead of windows 35)

eliminates the requirement for orienting the spring metal locking means (tabs 50 or tongues 82) toward a particular direction. The tongue 82 must register with a recess 73 for proper retraction. Also, the O-ring 84 holds the clip or clips 80 securely in engagement with the glass plug, and the beveled surface 68 at the end of the tube makes it very easy to insert the plug and clip and snap it in place. Once inserted, the plug cannot be removed except by shattering, since the clip is completely inaccessible.

in FIG. 14 is shown an improved removal tool comprising a screw driver 95 having a bellows 96 of rubber or the like mounted protectively around its blade end. A small cuff 97 on one end of the bellows fits snugly around the shaft of the screw driver and a larger cuff 98 on the other end of the bellows is designed to fit snugly around the head portion 61 of the lock tube. When a glass plug is to be removed, the cuff 98 is fitted onto the tube, the screw driver blade is driven against the plug to shatter it and the glass splinters are carefully worked out of the tube, by means of the screw driver blade, and into the bellows for safe disposal. Since the protected lock is normally installed in a horizontal position, such cleaning out of the broken glass is not too difficult. The inner closure 66, usually plastic, is removed by means of a tool engaging the recess 66', corresponding to recess 34 in closure 31.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

What I claim is:

1. A frangible plug assembly for sealing an opening in one end of a tubular member, comprising a head portion at least as large as the opening, a base portion adapted to extend from the head portion into the tubular member, both of said portions being of frangible material, and a locking element engaged with the base portion and said element including a resiliently deformable projection adapted to be non-releasably engaged with the tubular member.

2. A frangible plug assembly according to claim 1 wherein the head and base portions are glass.

3. A frangible plug assembly according to claim 1 wherein the base portion is formed with at least one flat side having a transverse groove and the locking element has a portion engaged with said groove.

4. A frangible plug assembly according to claim 1 wherein the base portion is formed with two parallel flat sides adapted to form, with a tubular member to be sealed, two segmentally profiled spaces, a locking element being located in each said space and each locking element being in mechanical engagement with the base portion and being engageable with the tubular member.

5. A frangible plug assembly according to claim 4 wherein the locking element includes a resiliently deformable projection adapted to be non-releasably engaged with the tubular member.

6. A frangible plug assembly according to claim 2 wherein the inner face of the plug is adapted to bear indicia, visible from outside the plug.

7. In combination, a frangible plug assembly according to claim 1 wherein the base portion is provided with an annular groove and a locking element having a portion engaged in said groove.

8. In combination, a frangible plug assembly according to claim 1 and a locking element having a projection which includes a latch surface facing toward the head portion of the plug.

9. In combination, a plug assembly according to claim 1 wherein the base portion is provided with an annular groove and at least one lateral recess, and the locking element comprises an arcuately bent plate having a grooved portion and a tongue portion, the tongue portion being retractable into said recess.

10. A frangible plug assembly according to claim 1 wherein the outer face of the head portion is adapted to bear indicia and the indicia is designed to permit viewing of the interior of the plug.

11. A frangible plug assembly according to claim 10 which includes indicia on the inner face of the plug.

12. A frangible plug assembly according to claim 1 wherein the tubular member is provided with a flanged extension, the head portion of the plug being adapted to fit at least partially within said extension.

13. A frangible plug for sealing an opening in one end of a tubular member, comprising a glass head portion at least as large as the opening and a glass base portion adapted to extend from the head portion into the tubular member, the base portion being formed with at least one flat side area and the end of the base portion having applied coloration so located as to be visible directly through the head portion on the axis of the plug and also by reflection from said flat side area.

* * * * *